US008747084B2

(12) United States Patent
Richardson et al.

(10) Patent No.: US 8,747,084 B2
(45) Date of Patent: Jun. 10, 2014

(54) PERISTALTIC PUMP

(75) Inventors: Brandon Richardson, Palo Alto, CA (US); Joshua Carter, San Francisco, CA (US)

(73) Assignee: Aperia Technologies, Inc., Burlingame, CA (US)

( * ) Notice: Subject to any disclaimer, the term of this patent is extended or adjusted under 35 U.S.C. 154(b) by 210 days.

(21) Appl. No.: 13/188,400

(22) Filed: Jul. 21, 2011

(65) Prior Publication Data

US 2012/0020822 A1 Jan. 26, 2012

Related U.S. Application Data

(60) Provisional application No. 61/400,033, filed on Jul. 21, 2010, provisional application No. 61/433,862, filed on Jan. 18, 2011.

(51) Int. Cl.
*F04B 43/14* (2006.01)

(52) U.S. Cl.
USPC ..... 417/477.3; 417/477.6; 417/476

(58) Field of Classification Search
CPC ..... F04B 43/14; F04B 43/1238
USPC ..... 414/474, 475, 476, 477.1, 477.2, 477.3, 414/477.4, 477.5, 477.7, 477.8, 477.6, 414/477.9, 477.11, 477.12, 477.13
See application file for complete search history.

(56) References Cited

U.S. PATENT DOCUMENTS 2,211,935 A 8/1940 Parker
2,415,618 A 2/1947 West
2,899,907 A * 8/1959 Becher ..... 417/477.6
3,012,820 A 12/1961 King
3,047,339 A 7/1962 Hamer
3,152,553 A * 10/1964 Rydberg ..... 417/477.1
3,249,059 A * 5/1966 Renn ..... 417/477.6
3,532,449 A 10/1970 Garton
3,886,974 A 6/1975 Bjorklund
3,981,633 A 9/1976 Wall
4,030,300 A 6/1977 Thompson
4,095,923 A 6/1978 Cullis
4,121,472 A 10/1978 Vural et al.
4,157,530 A 6/1979 Merz
4,256,971 A 3/1981 Griffith
4,291,235 A 9/1981 Bergey, Jr. et al.
4,370,894 A 2/1983 Sturesson
4,536,668 A 8/1985 Boyer
4,606,710 A 8/1986 Maguire
4,637,152 A 1/1987 Roy
4,807,487 A 2/1989 Seidl (Continued)

FOREIGN PATENT DOCUMENTS

WO 2009034321 A 3/2009
WO 2012012617 A 1/2012

*Primary Examiner* — Devon Kramer
*Assistant Examiner* — Nathan Zollinger
(74) *Attorney, Agent, or Firm* — Jeffrey Schox; Diana Lin

(57) ABSTRACT

A peristaltic pump system including an arcuate pressing surface, a force element that applies an occluding force towards the pressing surface, a drive mechanism that drives the force element, a diaphragm disposed between the pressing surface and the force element that defines a pump cavity, an actuator strip disposed between the diaphragm and the force element that receives the occluding force, deflects to deform the diaphragm, and occludes the pump cavity, a support structure that retains the actuator and diaphragm positions relative to the pressing surface, and a restitution mechanism that recovers the open pump cavity configuration.

20 Claims, 9 Drawing Sheets

(56) References Cited

U.S. PATENT DOCUMENTS

| | | | |
|---|---|---|---|
| 4,819,593 | A | 4/1989 | Bruener et al. |
| 4,852,528 | A | 8/1989 | Richeson et al. |
| 4,893,459 | A | 1/1990 | Orlando |
| 4,910,148 | A | 3/1990 | Sorensen et al. |
| 4,922,984 | A | 5/1990 | Dosjoub et al. |
| 5,018,797 | A | 5/1991 | Takata |
| 5,052,456 | A | 10/1991 | Dosjoub |
| 5,173,038 | A | 12/1992 | Hopfensperger et al. |
| 5,201,968 | A | 4/1993 | Renier |
| 5,293,919 | A | 3/1994 | Olney et al. |
| 5,325,902 | A | 7/1994 | Loewe et al. |
| 5,342,177 | A | 8/1994 | Cheng |
| 5,370,711 | A | 12/1994 | Audit et al. |
| 5,375,984 | A | 12/1994 | Wehling |
| 5,388,470 | A | 2/1995 | Marsh, Jr. |
| 5,409,049 | A | 4/1995 | Renier |
| 5,413,159 | A | 5/1995 | Olney et al. |
| 5,429,927 | A | 7/1995 | Afseth et al. |
| 5,468,129 | A | 11/1995 | Sunden et al. |
| 5,482,447 | A | 1/1996 | Sunden et al. |
| 5,495,879 | A | 3/1996 | Cabestrero |
| 5,512,439 | A | 4/1996 | Hornes et al. |
| 5,525,493 | A | 6/1996 | Hornes et al. |
| 5,591,281 | A | 1/1997 | Loewe |
| 5,646,727 | A | 7/1997 | Hammer et al. |
| 5,667,606 | A | 9/1997 | Renier |
| 5,707,215 | A | 1/1998 | Olney et al. |
| 5,759,820 | A | 6/1998 | Hornes et al. |
| 5,894,757 | A | 4/1999 | Sully |
| 5,941,692 | A | 8/1999 | Olney et al. |
| 5,941,696 | A | 8/1999 | Fenstermacher et al. |
| 6,092,545 | A | 7/2000 | Bedore et al. |
| 6,267,450 | B1 | 7/2001 | Gamble |
| 6,463,798 | B2 | 10/2002 | Niekerk et al. |
| 6,474,832 | B2 | 11/2002 | Murray |
| 6,482,592 | B1 | 11/2002 | Lundeberg et al. |
| 6,494,693 | B1 | 12/2002 | Sunden |
| 6,742,386 | B1 | 6/2004 | Larson |
| 6,744,356 | B2 | 6/2004 | Hamilton et al. |
| 6,787,233 | B1 | 9/2004 | Molteberg et al. |
| 6,814,547 | B2 | 11/2004 | Childers et al. |
| 6,871,683 | B2 | 3/2005 | Cobb |
| 6,984,702 | B2 | 1/2006 | Fonnum et al. |
| 6,986,913 | B2 | 1/2006 | Fonnum et al. |
| 6,994,136 | B2 | 2/2006 | Stanczak |
| 7,117,731 | B2 | 10/2006 | Hrabal |
| 7,160,707 | B2 | 1/2007 | Fonnum et al. |
| 7,173,124 | B2 | 2/2007 | Deggerdal et al. |
| 7,217,762 | B1 | 5/2007 | Joergedal et al. |
| 7,222,487 | B1 | 5/2007 | Hinkley |
| 7,225,845 | B2 | 6/2007 | Ellmann |
| 7,237,590 | B2 | 7/2007 | Loewe |
| 7,255,323 | B1 | 8/2007 | Kadhim |
| 7,357,164 | B2 | 4/2008 | Loewe |
| 7,498,683 | B2 | 3/2009 | Landwehr |
| 7,506,663 | B2 | 3/2009 | Thomas et al. |
| 7,581,576 | B2 | 9/2009 | Nakano |
| 7,607,465 | B2 | 10/2009 | Loewe |
| 7,614,474 | B2 | 11/2009 | Yang |
| 7,625,189 | B2 | 12/2009 | Cheng |
| 7,704,057 | B2 | 4/2010 | Malbec et al. |
| 7,748,422 | B2 | 7/2010 | Bol |
| 7,763,689 | B2 | 7/2010 | Fonnum et al. |
| 7,784,513 | B2 | 8/2010 | Loewe |
| 7,810,582 | B2 | 10/2010 | Webb |
| 7,828,095 | B2 | 11/2010 | Murata et al. |
| 7,828,101 | B2 | 11/2010 | Radtke et al. |
| 7,847,421 | B2 | 12/2010 | Gardner et al. |
| 7,856,871 | B2 | 12/2010 | Mancosu et al. |
| 7,927,170 | B2 | 4/2011 | Bickerton et al. |
| 7,931,061 | B2 | 4/2011 | Gonska et al. |
| 7,975,789 | B2 | 7/2011 | Murata |
| 7,985,340 | B2 | 7/2011 | Almaasbak et al. |
| 7,989,614 | B2 | 8/2011 | Deggerdal et al. |
| 7,989,975 | B2 | 8/2011 | Clement et al. |
| 8,004,104 | B2 | 8/2011 | Hench |
| 8,022,561 | B2 | 9/2011 | Ciglenec et al. |
| 8,038,987 | B2 | 10/2011 | Fonnum et al. |
| 8,042,586 | B2 | 10/2011 | Losey et al. |
| 8,083,503 | B2 | 12/2011 | Voltenburg, Jr. et al. |
| 8,110,351 | B2 | 2/2012 | Bosnes |
| 8,113,254 | B2 | 2/2012 | Benedict |
| 2007/0151648 | A1 | 7/2007 | Loewe |
| 2008/0247883 | A1 | 10/2008 | Yokomachi et al. |
| 2010/0243121 | A1 | 9/2010 | Eigenbrode |
| 2011/0061621 | A1 | 3/2011 | Finkenbiner |

* cited by examiner

PERISTALTIC PUMP

CROSS-REFERENCE TO RELATED APPLICATIONS

This application is related to U.S. Provisional Application No. 61/400,033 filed on 21 Jul. 2010 and U.S. Provisional Application No. 61/433,862 filed on 18 Jan. 2011, which are both incorporated in their entirety by this reference.

TECHNICAL FIELD

This invention relates generally to the pumping field, and more specifically to a new and useful peristaltic pump in the pumping field.

BACKGROUND

Peristaltic pumps are used in numerous applications and industries, ranging from pharmaceutical manufacturing to waste management to automotive applications. Conventional peristaltic pumps function on the principle of rotating a rotor with a cam against a tube. The tube is compliant enough to completely collapse under the cam force, but is elastic enough to recover a normal cross section after pressing of the cam ("restitution" or "resilience"), which induces fluid flow into the pump, maintaining fluid flow. In many applications, high operational pressures and long tube lifespans are desirable. While high pressures are typically achieved with hose pumps using thick-walled, reinforced tubes, these hose pumps suffer from shorter tube lifespans due to the thick tube walls and the large forces required to completely occlude the tubes. Longer tube lifespans may be achieved by utilizing thin-walled, ovular or lemon-shaped tubing, but these tubes are incapable of achieving the desired pressures, as the tubes expand to accommodate the difference between the internal and external pressures. Furthermore, these ovular tubes may not achieve complete restitution, resulting in pumping inefficiencies. Additionally, conventional peristaltic pumps directly couple the cam to the tubing, generating heat and friction as the cam translates over the tube. This heat and friction shortens tubing life.

Thus, there is a need in the peristaltic pumping field for a new peristaltic pump with a long lifespan, is operable under high pressures in continued service, can achieve adequate restitution, and reduces friction and heating of the tube. This invention provides such new peristaltic pump.

DESCRIPTION OF THE PREFERRED EMBODIMENTS

The following description of the preferred embodiments of the invention is not intended to limit the invention to these preferred embodiments, but rather to enable any person skilled in the art to make and use this invention.

Figure 1A:
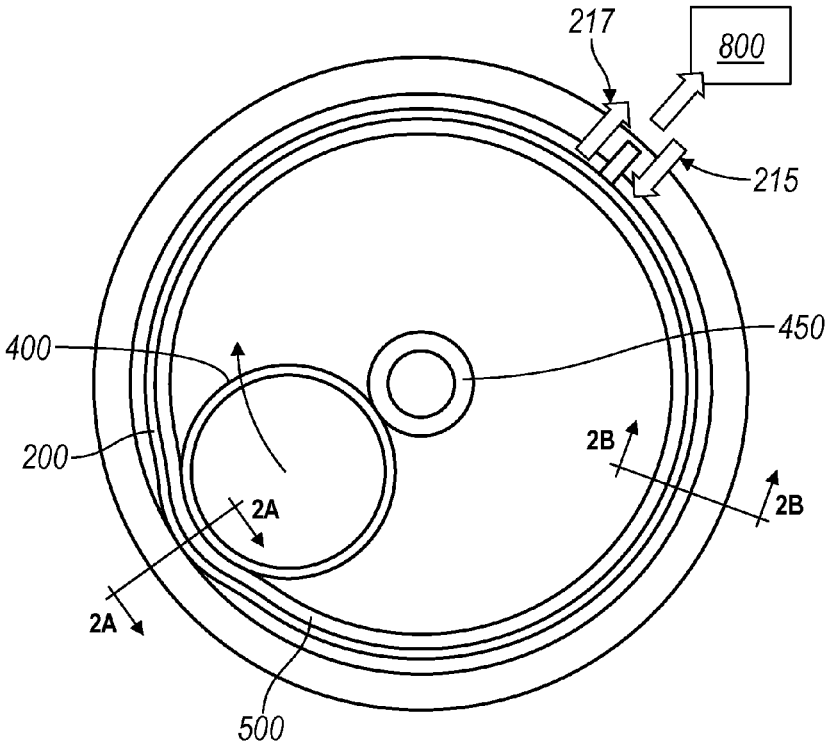
FIGS. 1A and 1B are side view of a first embodiment of the peristaltic pump of the preferred embodiment and a close up view of the peristaltic pump occlusion, respectively.
Figure 1B:
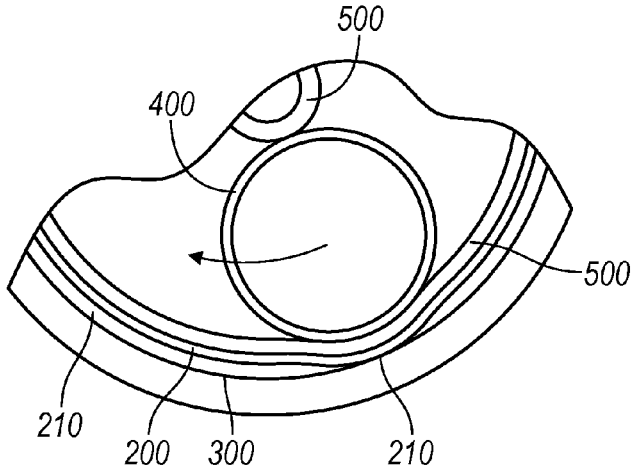
Figure 2A:
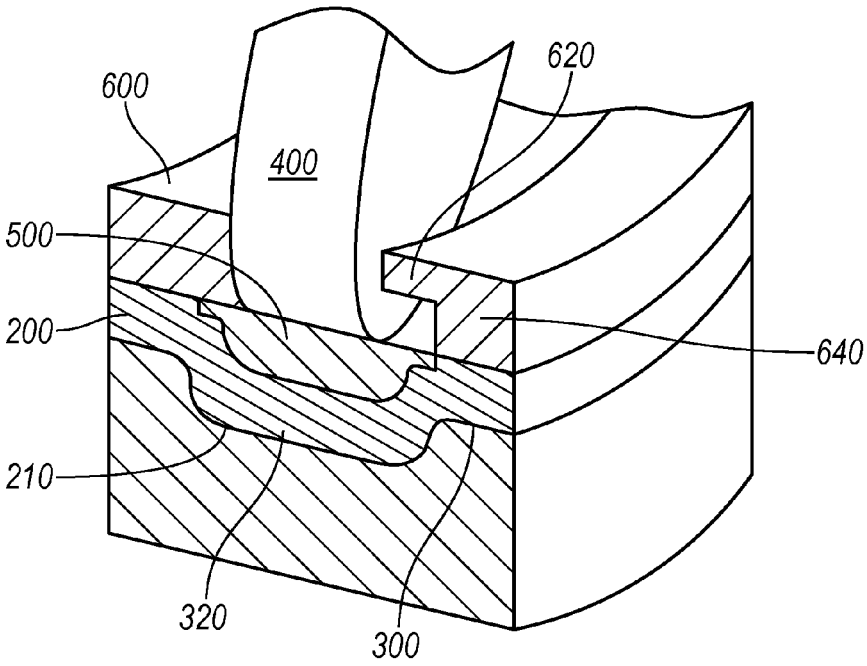
FIGS. 2A and 2B are perspective views along Section A-A and Section B-B of the peristaltic pump of FIG. 1, respectively.
Figure 2B:
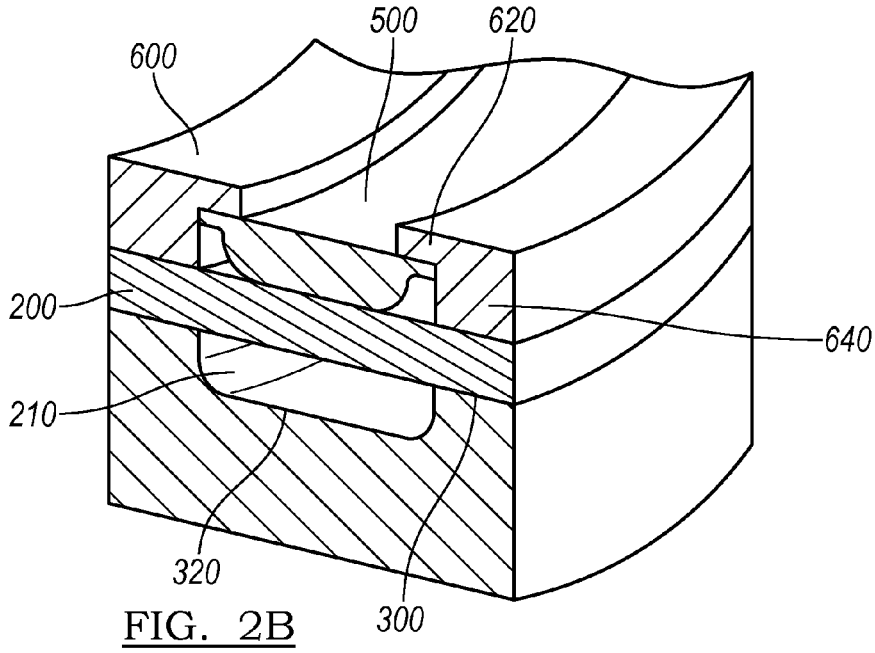
Figure 3A:
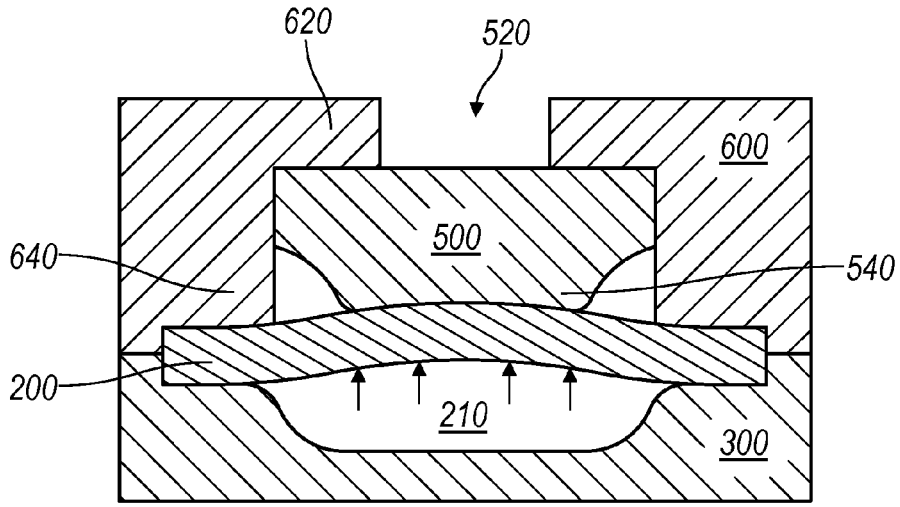
FIGS. 3A, 3B, and 3C are cross sectional views of a section of the peristaltic pump in pressurized mode, occluded mode, and rest mode, respectively.
Figure 3B:
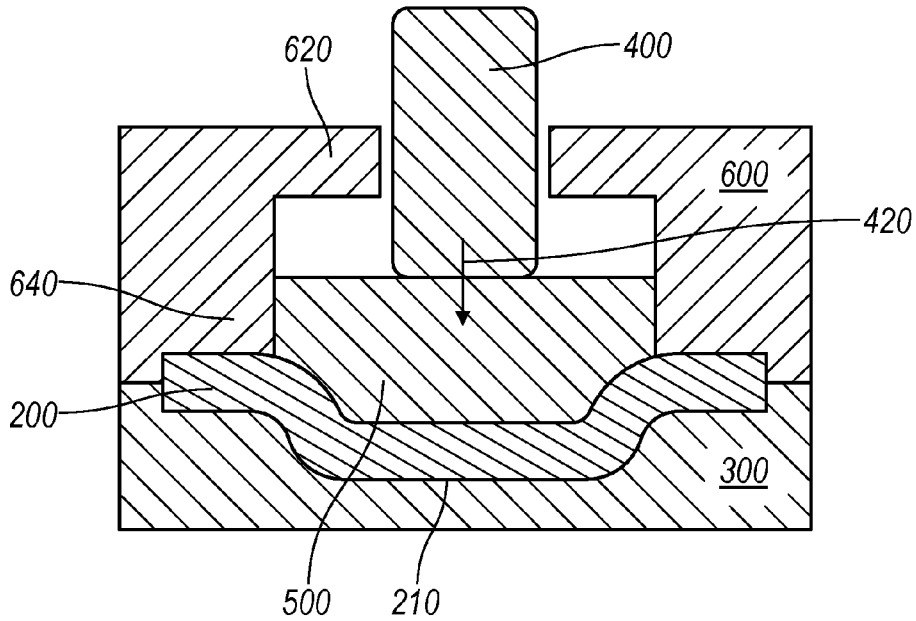
Figure 3C:
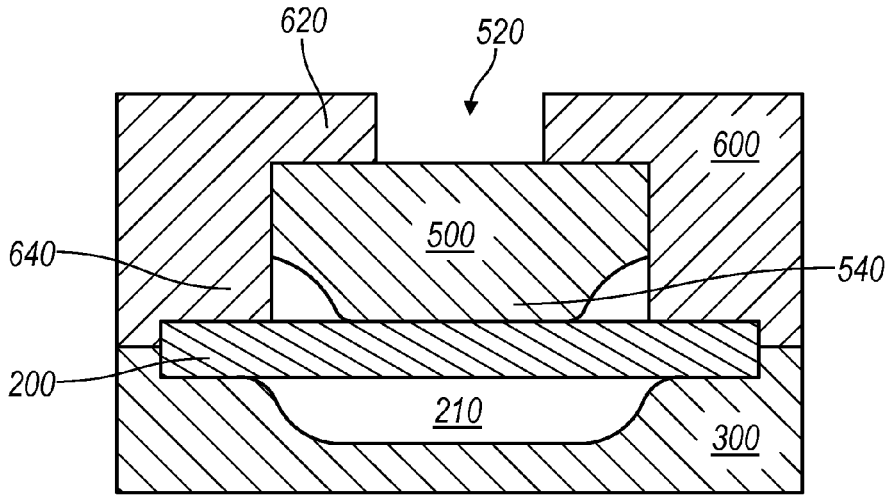
Figure 4A:
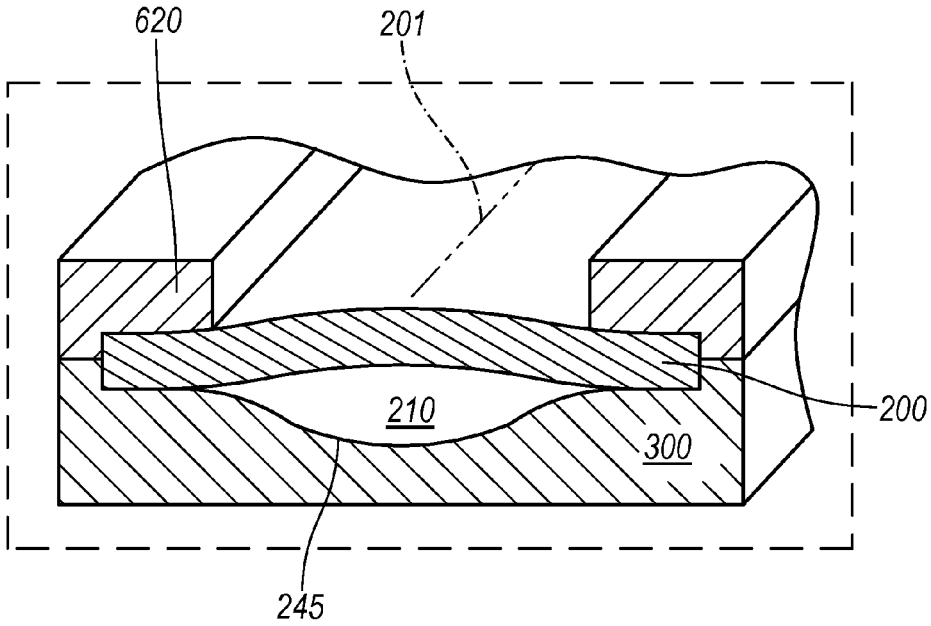
FIGS. 4A, 4B, 4C, and 4D are perspective views of a first, second, third, and fourth embodiment of the diaphragm, respectively.
Figure 4B:
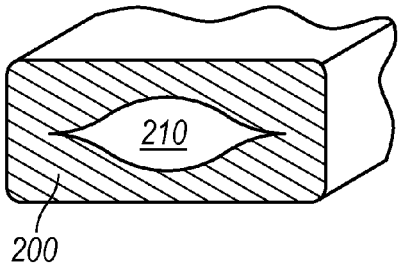
Figure 4C:
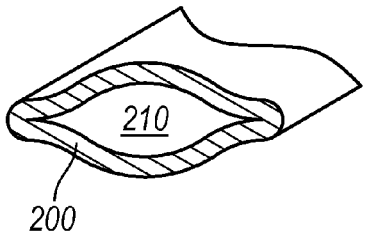
Figure 4D:
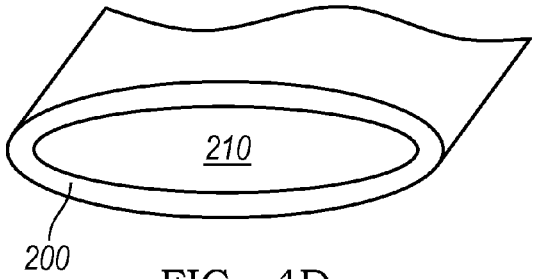

As shown in FIG. 1, the peristaltic pump 100 includes a pressing surface 300, a diaphragm 200 that defines a deformable volume 210, an actuator 500, a support structure 600, a force element 400 driven by a drive mechanism 450, and a restitution mechanism 700. The peristaltic pump 100 is preferably used to pump a fluid, preferably a gas but alternatively a liquid, from a fluid source into a reservoir 800. The peristaltic pump 100 is preferably utilized for tire inflation, but may alternatively be used for pumping medical fluids, biological fluids, industrial fluids, or any other suitable application. The peristaltic pump 100 is preferably arranged with the diaphragm 200 and the actuator 500 disposed between the pressing surface 300 and the force element 400, wherein the diaphragm 200 is coupled to the pressing surface 300 and the actuator 500 receives the force element 400. The support structure 600 preferably retains the diaphragm 200 and actuator 500 relative to the pressing surface 300, and preferably rigidly couples to the pressing surface 300. The drive mechanism 450 moves the force element 400, and biases the force element 400 to apply an occluding force 420 towards the pressing surface 300.

In operation, the force element 400 translates from the pump inlet 215 to the pump outlet 217, occluding successive sections of the deformable volume 210. These sections of the peristaltic pump 100 are preferably operable in three modes: a pressurized mode, an occluded mode, and a rest mode, as shown in FIGS. 3A, 3B and 2A, and 3C and 2B, respectively. As the force element 400 translates from the inlet 215 to the outlet 217, the sections downstream from the occlusion are preferably in pressurized mode (shown in FIG. 3A), wherein the pressure within the deformable volume 210 is higher than the ambient pressure. To maintain high pressurization, the support structure 600 maintains the position of the actuator 500 relative to the pressing surface 300, which, in turn, maintains the amount of deflection of the diaphragm 200. In other words, the support structure 600 prevents the deflection of the actuator 500, which prevents the stretching and expansion of the diaphragm 200, effectively maintaining the increased pressure. The sections receiving the occlusion force from the force element 400 are in occluded mode (shown in FIG. 3B). In occluded mode, the force element 400 applies an occluding force 420 to a localized section of the actuator 500, causing a section of the actuator 500 to deflect away from the force element 400. The deflected actuator 500 causes the corresponding section of the diaphragm 200 to deform, occluding the corresponding section of the deformable volume 210 (i.e. creating the occlusion). The sections upstream of the occlusion are preferably in rest mode (shown in FIG. 3C), wherein the deformable volume 210 has achieved restitution. In other words, the deformable volume 210 defined by the diaphragm 200 has preferably recovered an open configuration (e.g. a semicircular, amygdaloidal, ovular, or circular cross section), and is ready to accept fluid ingress. The restituted deformable volume 210 may additionally create a suction as the segment switches from an occluded mode to rest mode, and may promote fluid ingress into the deformable volume 210 through the inlet 215.

The peristaltic pump 100 of the preferred embodiments may provide several benefits arising from its geometry and construction. First, the peristaltic pump 100 may increase the lifespan of the diaphragm 200 by utilizing a flexible actuator 500 which functions to reduce diaphragm friction and wear as compared to prior art diaphragm peristaltic pumps, which typically utilize a rigid actuator ring (commonly referred to as rotary piston). This is achieved because a flexible actuator strip eliminates the tangential forces that act on a rigid actuator ring, which would otherwise force the membrane to slide against the occluding surface resulting in friction, wear, and heating. Second, the peristaltic pump 100 may have higher pressure-containment capabilities by preventing excess deflection of the actuator 500 through the use of the support structure 600, and by controlling the gap distance between the actuator 500 and the support structure 600 to minimize diaphragm 200 bulging. Third, the peristaltic pump 100 may achieves greater restitution of the deformable volume 210 after occlusion with the restitution mechanism 700, inducing fluid flow into the pump. Fourth, reducing the amount of force required to occlude the deformable volume reduces demands on drive-train structure, which may include a system which adjusts the position of the force member such that occlusion is achieved regardless of manufacturing variation or degradation of system geometry due to wear.

As shown in FIG. 1, the pressing surface 300 of the peristaltic pump 100 functions to provide a surface against which an occlusion of the deformable volume 210 is formed. The pressing surface 300 preferably provides a surface that supports the diaphragm 200 and allows the force element 400 to deform the deformable volume 210 against it. As shown in FIG. 1, the pressing surface 300 is preferably the interior radial surface of an arcuate element, such that the pressing surface is concave toward the diaphragm 200, but may alternatively be the exterior radial surface of an arcuate element, wherein the pressing surface 300 is convex toward the diaphragm 200, or the pressing surface 300 may be substantially flat. The pressing surface 300 preferably defines a groove 320 along a circumferential section that defines a portion, more specifically the lower portion, of the deformable volume 210. The groove 320 of the pressing surface 300 is preferably a bell-shaped groove 320, but may alternatively be semicircular, butte-shaped, well-shaped, or substantially flat with angled edges. The groove 320 is preferably as long as the actuating length of the diaphragm 200, but may alternatively be shorter than the actuating length. The depth of the groove 320 is preferably equal to the thickness of the diaphragm 200, but may alternatively be shallower or deeper. The longitudinal edges of the groove 320 are preferably rounded, but may alternately be sharp. As shown in FIG. 4, the pressing surface 300 is preferably an arcuate surface of a continuous ring 310, wherein the groove 320 is an arcuate groove 320 tracing the circumference of the ring 310. The pressing surface 300 may alternatively be an arcuate surface on continuous ring wherein the groove 320 runs along a portion of the circumference, an arc of a ring 310 (e.g. the profile is semicircular) wherein the groove 320 runs along a portion of the arc, or a flat surface wherein the groove 320 runs along a portion of the length. The length of the pressing surface 300 is preferably longer and wider than the length and width of the deformable volume 210, respectively. The pressing surface 300 is preferably substantially rigid, such that the diaphragm 200 deforms against the pressing surface 300 when an occluding force 420 is applied to the diaphragm 200. The pressing surface 300 preferably comprises a polymeric material, such as PTFE, but may alternatively comprise a metallic material (such as steel or aluminum), ceramic material, or any other suitable material.

The diaphragm 200 of the peristaltic pump 100 functions to define a deformable volume 210 (lumen), which functions to contain a pumping fluid. The diaphragm 200 also functions to deform and occlude a section of the deformable volume 210 to control the fluid flow within the volume. The diaphragm 200 is preferably a long, rectangular sheet with a longitudinal centerline 201 running along its length (shown in FIG. 4A), but may alternatively be a tube disposed along the bearing surface 520 of the pressing surface 300, wherein the diaphragm 200 forms both the upper and lower halves of the deformable volume 210. The diaphragm 200 is preferably a tube with an amygdaloidal cross-section (e.g. ovular, tapering into two ogees along the major axes) (shown in FIGS. 4B and 4C), a tube with an ovular lumen cross section (shown in FIG. 4D), a tube with a round cross section, a tube with a butte-shaped cross section, or any other suitable configuration. The tube is preferably manufactured as a single, unitary piece, but may alternatively be manufactured as two pieces, wherein the desired cross section is created during assembly. The diaphragm 200 preferably has a substantially uniform thickness, but may have a variable thickness. The diaphragm 200 is preferably thick enough to hold the desired pressure, but thin enough to be deformed. The deforming portions of the diaphragm 200 (e.g. the portion deformed by the force element 400) preferably has thicknesses between 0.04" and 0.125" and, more preferably, has thicknesses between 0.06" and 0.08" but may have any other suitable thickness. A portion of the diaphragm 200 is preferably formed such that a bell-shape curve runs the length of the diaphragm 200, wherein the apex of the bell substantially coincides with the longitudinal centerline 201 of the diaphragm 200. However, the diaphragm 200 may alternatively be substantially flat. The diaphragm 200 is preferably substantially elastic and fatigue-resistant, and preferably comprises material compatible with the desired application. The material for the diaphragm 200 is preferably an elastomeric material. The diaphragm 200 preferably includes rubber, but may alternatively be a thermoset, thermoplastic or any material that has high elasticity and good restitution. Such materials include Santoprene, polyurethane, nitrile rubber, silicone rubber, and Elastron, and may vary dependent on the application. The diaphragm 200 is preferably extruded, but may alternatively be stamped, heat formed, injection molded, or manufactured by any other suitable method of obtaining the desired shape and structural properties.

Figure 5:
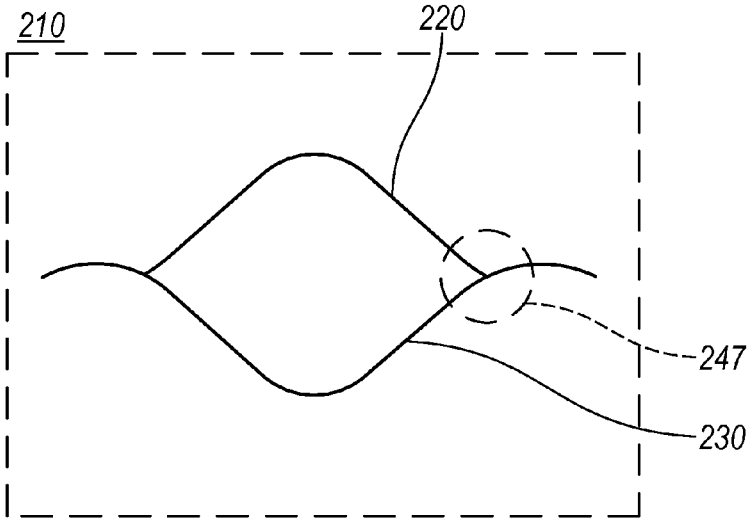
FIG. 5 is a view of a preferred embodiment of the deformable volume.

As shown in FIG. 5, the deformable volume 210 is preferably defined by the diaphragm 200 laid over a groove 320 in the pressing surface 300, wherein the diaphragm 200 forms the first half 220 of the deformable volume 210 and the groove 320 forms the second half 230. However, the diaphragm 200 may alternatively define the deformable volume 210 itself. The deformable volume 210 is preferably a tube or channel with an inlet 215 and an outlet 217, wherein the inlet 215 is fluidly coupled to a first volume containing fluid, and the outlet 217 is fluidly coupled to the a second volume that receives the pumped fluid. The deformable volume 210 is preferably formed from two sections, an first half 220 and a second half 230, which preferably join together at the sides to form two corners. The first half 220 is preferably formed by the diaphragm 200, and functions to receive the deforming (occluding) force and deforms to form an occlusion by sealing with the second half 230. The first half 220 preferably receives the deforming force substantially near the longitudinal centerline 201. The first half 220 is preferably substantially flat, but may alternatively be bowed in a smooth bell shape such that it is concave toward the second half 230, wherein the apex of the first half 220 is substantially near the longitudinal centerline 201, or may be slightly convex. The second half 230 is preferably defined by the pressing surface 300 (e.g. a groove 320 integral with the pressing surface 300), but may alternatively be defined by the diaphragm 200. The second half 230 functions to provide structural support such that the first half 220 may deform against it, and functions to form a seal with the first half 220 when the first half 220 is sufficiently deformed. The second half 230 is preferably a curved groove 320, such that it is concave toward the first half 220. The profile of the groove 320 is preferably an inverted bell-shape, such that it compliments the profile of the first half 220, but may alternatively be a flatter bell shape, semicircular, or entirely flat. The resultant cross sectional profile of the deformable volume 210 preferably well-shaped. This geometry allows the deformable volume 210 to be occluded with less strain on the diaphragm than a volume with a circular or ovular cross section. However, the cross sectional profile may alternatively be amygdaloid (or "almond-shaped"), wherein the profile bows outward at the middle and tapers to corners at the sides. The resultant cross sectional profile may alternatively be semicircular, substantially circular, or oblong. The depth of the groove 320 is preferably equal to the thickness of the material forming the first half 220, but may alternatively deeper or shallower. The benefits of this deformable volume 210 may include a more complete occlusion with lower applied force, and less strain within the membrane as it is deformed.

Although the peristaltic pump 100 preferably does not use any valves, the deformable volume 210 may include a valve at the inlet 215 and/or the outlet 217. The valves are preferably one-way valves, wherein the inlet 215 valve 216 only allows fluid ingress and the outlet 217 valve 218 only allows fluid egress out of the deformable volume 210. However, the valves may alternatively be two way valves, wherein the periodic occurrence of at least two rollers simultaneously occluding the deformable volume 210 and prevents fluid backflow. The two-way valves may also allow the peristaltic pump 100 to pump in two directions, or may be openings or materials that are selectively permeable to gas but not liquids. Examples of these openings include flaps coupled to the inlet 215 or outlet 217 that open slightly only when the flaps experience centrifugal force, channels that force ingressed liquid out of the deformable volume 210 via centrifugal force, or any suitable opening configuration that prevents fluid ingress or removes fluid from the deformable volume 210. Examples of materials that may be used include GORE-TEX fabric, microfilters, or any other material that selectively allows gas permeation. The peristaltic pump 100 may additionally include a partition, disposed within the deformable volume 210, that separates the pressurized, upstream fluid (e.g. at the outlet 217) from the unpressurized, downstream fluid (e.g. at the inlet 215). The partition may be preferable when the peristaltic pump 100 is a full ring, wherein the inlet 215 and outlet 217 are located substantially close to each other. Additionally, the outlet can be connected to a nitrogen membrane. The inclusion of the nitrogen membrane may dehumidify the pumped fluid and decrease the oxygen gas concentration, leading to a possible increase in the lifespan downstream systems which the pump 100 may be connected to. The outlet (and/or the inlet) may be additionally connected to a dessicant, such as water adsorption beads, water filters, water-adsorbing powder, etc., which may dehumidify the pumped fluid. The adsorption beads are preferably comprised of silica, but may alternatively comprise of any other material that adsorbs water.

As shown in FIG. 1, the actuator 500 of the peristaltic pump 100 functions to decrease wear on the diaphragm 200, to transfer the occluding force 420 applied by the force element 400 to the first half 220 of the deformable volume 210, and to maintain high pressures within the deformable volume 210. The actuator 500 preferably decreases the wear on the diaphragm 200 by significantly decreasing tangential forces, and by decoupling the rolling element from the diaphragm 200, which minimizes the effect of rolling friction on the diaphragm 200 as well as decreases the stress concentration of the occluding force 420 on the diaphragm 200 by diffusing the occluding force 420 over a larger area. The actuator 500 is preferably flexible but substantially strain resistant along its longitudinal axis, such that the actuator 500 does not extend under tension. The actuator 500 is preferably located between the diaphragm 200 and the force element 400, such that the occluding force 420 is first applied to the actuator 500, which deflects to deform the diaphragm 200 with the occluding force 420, effectively occluding the deformable volume 210. The actuator 500 is preferably constrained along its longitudinal axis with respect to the deformable volume 210 by the actuator restraint 620, such that it does not shift or slide against the deformable volume 210. However, the actuator 500 may be constrained only on its ends, or may not be mechanically restrained at all. The actuator 500 is preferably a continuous ring, but may alternatively be a long, thin strip that forms a ring, forms a portion of a ring (e.g. an arc), or is flat. The length of the actuator 500 is preferably slightly longer than the length of the deformable volume 210, but may alternatively be the same length as the deformable volume 210, or shorter. The height of the actuator 500 is preferably as thin as possible without bowing under pressure, while thick enough to contain the appropriate occluding geometry, and is preferably substantially equivalent to the material thickness of the upper portion 320 of the support structure 600, but may alternatively be shorter or taller than the thickness. The actuator 500 is preferably held taut (i.e. in tension) against the force element 400 during operation such that the undeflected portion of the actuator 500 contacts the actuator restraint 620 at all times, but with enough compliance to allow substantially free movement of the force element 400 along the actuator 500 surface. This is preferably accomplished by geometry (e.g. the actuator has a specified diameter that keeps it in tension), but may be stretched to fit over the force element 400 during assembly, cinched taut after fitting over the force element 400 during assembly, or utilize any other suitable method of achieving a taut actuator 500 over the force element 400. However, the actuator 500 may only be loosely coupled to the force element 400.

Figure 6A:
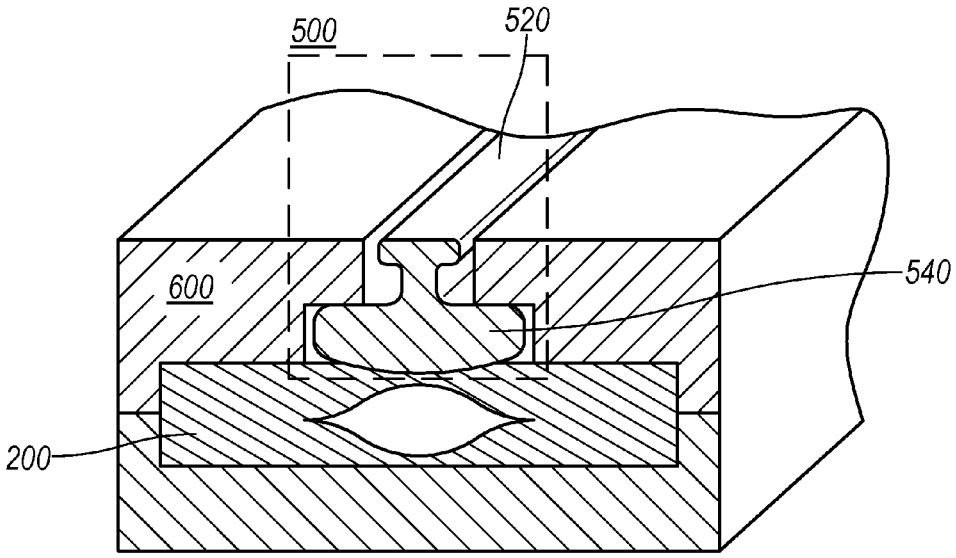
FIGS. 6A and 6B are perspective views of a first and a second embodiment of the actuator strip, respectively.
Figure 6B:
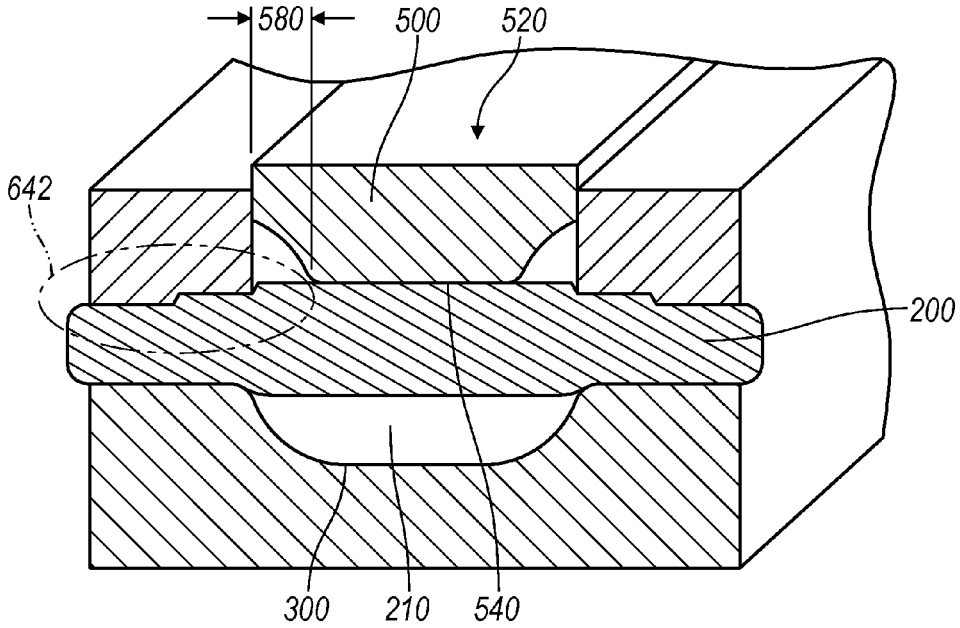
Figure 7A:
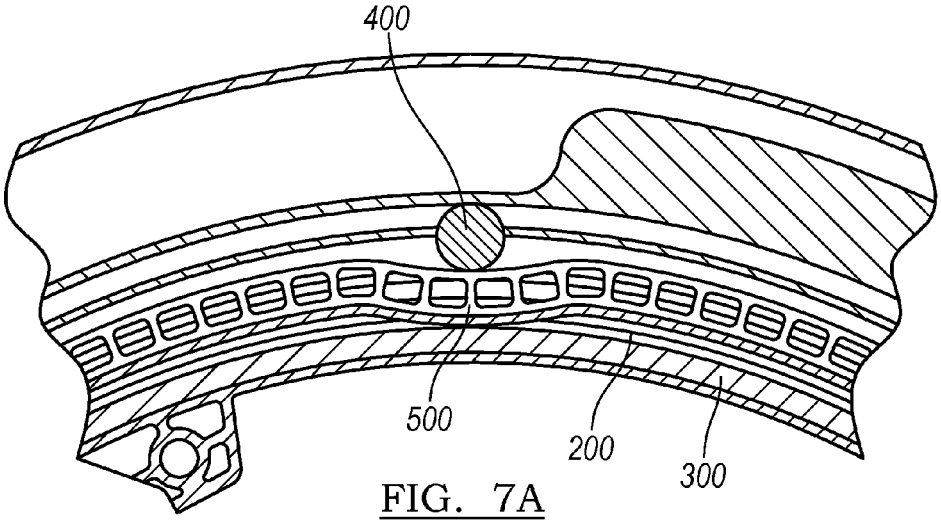
FIGS. 7A, 7B, and 7C are views of a third embodiment of the actuator strip in a side view of the actuator strip integrated within a system, a side view of the actuator strip alone, and a side view of the deflected actuator strip, respectively.
Figure 7B:
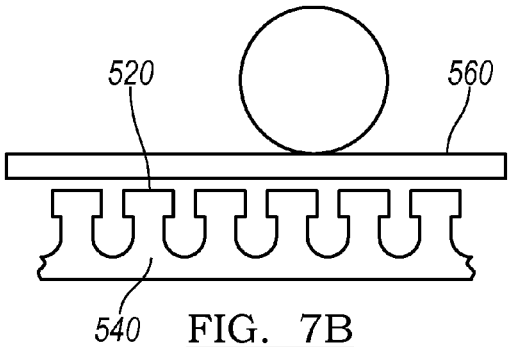
Figure 7C:
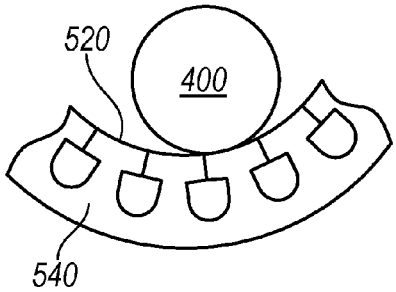
Figure 8:
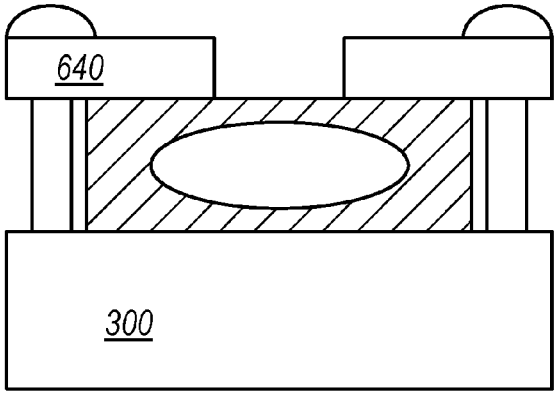
FIG. 8 is a cross-sectional of an embodiment of the diaphragm restraint.

As shown in FIGS. 6A and 6B, the actuator 500 includes a bearing surface 520 and an occluding surface 540 (actuation surface), wherein the bearing surface 520 transfers the occluding force 420 (provided by the force element 400) to the corresponding section of the occluding surface 540 that deforms the corresponding section of the diaphragm 200, which effectively occludes the corresponding section of the deformable volume 210. The bearing surface 520 is preferably a smooth, continuous strip, but may alternatively include a series of smooth, flat surfaces that transiently couple together to form an arc when the rolling element passes by, a single smooth curved surface, or any surface that facilitates the unobstructed movement of the force element 400 over the actuator 500. The occluding surface 540 contacts and deforms the diaphragm 200, and is preferably a smooth, continuous strip the length of the actuator 500, but may alternatively be a series of rods or flat strips running along the length of the actuator 500. The width of the occluding surface 540 is preferably close to the width of the deformable volume 210. More preferably, the width of the occluding surface 540 is approximately 98% of the width of the deformable volume 210, and fits within the occluding gap. The occluding surface 540 is preferably shaped to fit the profile of the second half 230 of the deformable volume 210, such that the occluding surface 540 substantially compliments (e.g. substantially traces) the lower half of the deformable volume 210, but may alternatively be complimentary to the body and edges of the lower half (e.g. groove 320), be flat with rounded edges (wherein the edges are convex), be butte-shaped (wherein the edges are concave), with a wide bearing surface 520 and a narrow occluding surface 540 with curved side walls, or any suitable shape. The actuator 500 is preferably a solid piece, but, as shown in FIG. 7, the actuator 500 may include a series of T-shaped protrusions linked by a continuous strip at the stems of the Ts. As shown in FIG. 7B, the connection between the T stems are preferably curved. As shown in FIG. 8*c*, the top of the Ts preferably form the bearing surface 520, and the continuous linking strip preferably forms the occluding surface 540. The actuator 500 of this embodiment is preferably molded as a single piece, but may alternatively be sintered, extruded or stamped. The actuator 500 is preferably manufactured as a unitary piece from wear-resistant, flexible material, such as nylon, PEEK or Nitinol, but may alternately be manufactured from multiple pieces (e.g. a durable bearing surface 520 and a softer occluding surface 540). The bearing surface 520 of the actuator 500 is preferably reinforced by a wear-resistant material, such as metal, PEEK, or reinforced polymer. The actuator 500 may alternatively comprise of a series of laminated strips, wherein each strip is the length of the actuator 500 and the lamination surfaces of the strips run perpendicular to the occlusion force application direction. In this embodiment, the layers of the actuator 500 are preferably made of the same material, but may alternatively be made of different materials with different elasticities, wear properties, and thicknesses. Examples of preferred materials include nylon, PEEK, nitinol, and rubber. The strips are preferably held in place by the support structure 600, but may alternatively be laminated with a flexible lamination such as rubber glue. In one preferred embodiment of the laminated actuator 500, the actuator comprises two concentric rings (or strips): a bearing ring that forms the bearing surface, and an occluding ring that forms the occluding surface. The bearing ring is preferably thin and substantially stiff, such that the bearing ring does not stretch in the longitudinal direction under tangential load. The bearing ring is preferably tensioned against the actuator restraint 620 of the support structure 600, but can be otherwise biased to facilitate restitution of the diaphragm. The occluding ring is preferably substantially thicker than the bearing ring (e.g. 3 times thicker, 10 times thicker, 100 times thicker) and more pliable than the bearing ring, such that the occluding ring achieves the desired bend radius without reaching its fatigue limit. However, the laminated actuator 500 may have any other suitable construction and form.

As shown in FIG. 7B, the actuator 500 may additionally include a surface strip 560, which functions to prevent overstressing of the actuator 500 due to rolling forces of the force element 400, and to reduce diaphragm friction and wear. The surface strip 560 preferably lies on the top surface of the actuator 500, and is preferably restrained such that it remains aligned with the actuator 500 and the force element 400, and is slidably coupled to the top surface of the actuator 500 during operation. The surface strip 560 is preferably made of a similar material as the actuator 500, but may alternatively be made of a different material. The length of the surface strip 560 is preferably similar to that of the actuator 500, but may alternatively be longer or shorter than the actuator 500. The width of the surface strip 560 is preferably four times wider than the bearing surface 520, but may alternatively be wider or narrower. The thickness of the surface strip 560 is preferably as thick as allowable by the fatigue strength of the material, but may alternatively be equal to the thickness of the continuous linking strip.

The support structure 600 of the peristaltic pump 100 functions to constrain the diaphragm position relative to the pressing surface 300 and to retain the actuator strip position relative to the diaphragm 200. The support structure 600 may additionally function to restrain the actuator 500 from excessive deflection during fluid pressurization (thereby allowing the peristaltic pump 100 to achieve higher pressures), to prevent gap formation during the deformation and pressurization process, and/or to guide the application of the occluding force 420. As shown in FIGS. 1, 6B and 9, the support structure 600 preferably includes a diaphragm restraint 640 that retains the diaphragm position relative to the pressing surface 300, and an actuator restraint 620 that retains the actuator strip position relative to the pressurized diaphragm 200. The diaphragm restraint 640 preferably retains only the edges of the diaphragm 200, leaving the center of the diaphragm 200 free to receive a deforming/occluding force 420 (from the actuator 500 or the force element 400). The diaphragm restraint 640 preferably prevents the shifting of the diaphragm 200 by retaining the edge positions of the diaphragm 200 relative to the pressing surface 300, and preferably restrains the longitudinal edges of the diaphragm 200 against the pressing surface 300 to prevent leakage of pressurized fluid. Alternatively, the diaphragm restraint 640 may restrain the lateral edges of the diaphragm 200 against the pressing surface 300, or restrain the diaphragm position relative to the pressing surface 300 in any suitable manner. The diaphragm restraint 640 preferably clamps the diaphragm edges against the pressing surface 300 by screwing or clipping into/onto the pressing surface 300, but may alternatively clip, screw, buckle, or otherwise retain the diaphragm edges against the pressing surface 300. Furthermore, the diaphragm-coupling surface of the support structure 600 and/or pressing surface 300 may include retention features 642 (shown in FIG. 6B) or textures, such as diamond grids, progressively smaller steppes toward the center of the diaphragm 200 (e.g. the center portions of the diaphragm 200 are less compressed than the edges), microhooks, specialized surface coatings (e.g. coatings that promote Van-der-Waals interactions between the surfaces and the diaphragm 200), or any suitable retention feature. The edges of the diaphragm 200 may additionally be adhered to the support structure 600 and/or pressing surface 300. The actuator restraint 620 of the support structure 600 preferably retains the edges of the actuator 500, leaving a gap such that the center of the actuator 500 is free to receive an occluding force 420 from the force element 400. The gap width is preferably substantially the width of the force element 400, and preferably guides the force element 400 along the length of the actuator 500. Furthermore, this gap is preferably centered over the diaphragm 200. The actuator restraint 620 is preferably movably coupled to the actuator 500, and preferably only braces the actuator 500, preventing the actuator 500 from deflecting past a maximum deflection threshold from the undeflected diaphragm 200 (measured from the undeflected diaphragm position, the diaphragm edges, or the top surface of the diaphragm restraint 640). In doing so, the actuator restraint 620 allows the system to achieve higher pressures, as it prevents uncontrolled deflection of the actuator 500 and expansion of the diaphragm 200 during pressurization. As shown in FIGS. 1 and 3, the actuator 500 is preferably restrained along the longitudinal edges of the bearing surface 520, wherein the longitudinal edges are retained by a pair of overhanging braces (flanges), such that they are disposed between the support structure 600 and the first half 220 of the diaphragm 200. However, the actuator restraint 620 may be achieved by constraining the ends of the actuator 500 with the support structure 600, such that the ends of the actuator 500 are constrained between an upper portion and the lower portion of the actuator restraint 620, or inserted into the actuator restraint 620. The actuator 500 edges are preferably spaced from the actuator restraint 620 on each side by a controlled gap 580, wherein the width of the controlled gap 580 substantially prevents the diaphragm 200 from bulging into the gap when the deformable volume 210 is under pressure. The width of the controlled gap 580 is preferably equal to the diaphragm thickness. The actuator restraint 620 preferably includes rigid overhangs (e.g. flanges) over the longitudinal edges of the bearing surface 520 of the actuator 500, located a predetermined distance from the undeflected diaphragm 200, that cooperatively retain the actuator strip position against the diaphragm 200 and prevent excessive deflection. However, the actuator restraint 620 may include slots, mechanical couples, or any suitable configuration. The actuator restraint 620 is preferably located above and coupled to the diaphragm restraint 640, and is more preferably an integral piece with the diaphragm restraint 640. The support structure 600 preferably couples to the pressing surface 300 by the diaphragm restraint 640, but may alternatively be an integral piece with the support structure 600. The support structure 600 is preferably arcuate with a smaller radius than the pressing surface 300, more preferably circular. However, the support structure 600 may be flat. The support structure 600 preferably comprises one piece, but may alternatively comprise multiple pieces that couple together to retain the diaphragm 200 and actuator strip positions. The support structure 600 is preferably made of metal such as aluminum, but may alternatively be made of other metals such as stainless steel, a rigid polymer such as PEEK, an elastomeric polymer such as polyurethane, or ceramic. The support structure 600 is preferably extruded, but may be roll formed, stamped, welded, sintered, or manufactured using any other suitable method of obtaining the desired shape and structural properties.

As shown in FIG. 2, the force element 400 of the peristaltic pump 100 functions to provide an occluding force 420 to successive sections of the actuator 500, which deforms the corresponding successive sections of the diaphragm 200 and occludes the corresponding sections deformable volume 210. The force element 400 preferably accomplishes this by translating along the bearing surface 520 of the actuator 500 (disposed along the first half 220 of the deformable volume 210), preferably within the occluding gap formed between the sides of the actuator restraint 620, wherein contact of the force element 400 with the actuator 500 provides a force against the first half 220 of the diaphragm 200 to occlude the deformable volume 210. The force element is preferably a cam, and more preferably a roller, but may alternately be a shoe or any other suitable device. The force element 400 preferably rolls along the bearing surface 520 of the actuator 500, but may alternatively slide along the bearing surface 520. The force element 400 preferably has a rounded bearing surface 520, and is preferably cylindrical with rounded edges, but may alternatively be cylindrical with substantially angled edges, spheroid (e.g. a bearing), oblong, or rectangular. The force element 400 preferably has a radius larger than the total combined thickness of first half 220 of the diaphragm 200 and the upper portion 320 of the support structure, but may alternatively be substantially the same as the thickness of the first half 220, slightly larger than the thickness of the first half 220, substantially equivalent to the total thickness of the first half 220 and the upper portion 320, or substantially smaller than the diaphragm 200 thickness. The width of the force element 400 is preferably as large as allowable by the clearance requirements of the occluding gap. However, the width of the force element 400 may be substantially less than the width of the deformable volume 210, the same as the width of the deformable volume 210 or larger. The peristaltic pump 100 preferably includes one force element 400, but may alternatively include any number of force elements 400. The force element 400 is preferably made of a stiff, incompressible material such as stainless steel, PVC, or ceramic. The material comprising the force element 400 is preferably wear-resistant, but the force element 400 may alternatively include a wear-resistant coating on the radial surface such as Rulon or Ceramic. The force element 400 may alternatively be flexible and compliant, such that the force element(s) 400 may accommodate for manufacturing and system tolerance variations, and for diaphragm thickness changes over time. The flexible force element 400 is preferably made of spring steel, but may alternatively be made from any metal or polymer that is wear resistant and compliant.

The force element 400 of the preferred embodiment may additionally include a spacing element that holds multiple force elements 400 in spatial relation with each other. The spacing element is preferably a spacing ring disposed between the rotor of the drive mechanism 450 and the pressing surface 300 that includes cutouts that compliment the roller profiles and allow roller rotation within the cutouts. Alternatively, the spacing element may include arms, coupled to the rollers, that are rigidly spaced apart, or arms coupled to the rollers that are spaced apart by springs. However, any suitable spacing element may be used to retain the relative spatial orientation of the force elements 400 during translation.

Figure 9A:
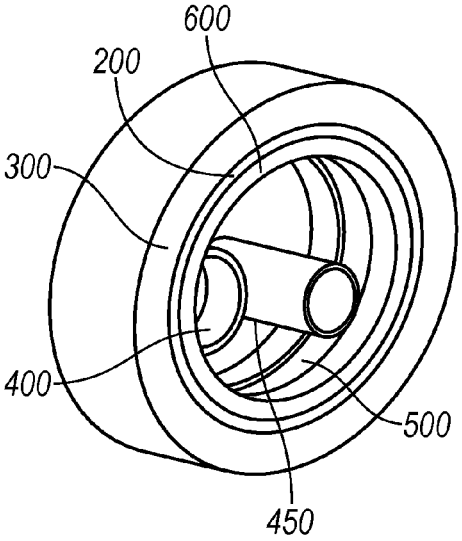
FIGS. 9A and 9B are perspective views of a first and second embodiment of the drive mechanism, respectively.
Figure 9B:
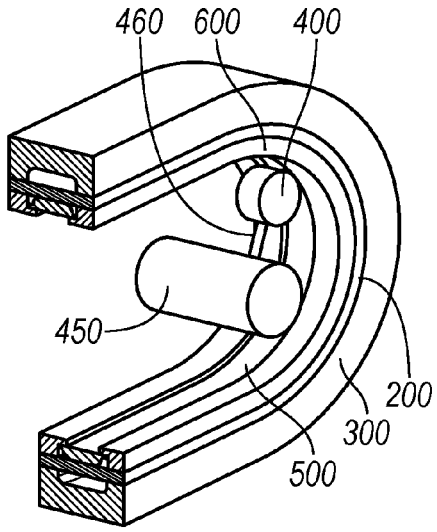

As shown in FIG. 9, the drive mechanism 450 of the peristaltic pump 100 functions to translate the force element 400 and to generate the occluding force 420 in conjunction with the force element 400. The drive mechanism 450 is preferably located substantially in the center of the peristaltic pump 100, such that the pressing surface 300, diaphragm 200, and actuator 500 are wrapped about the circumference of the drive mechanism 450, and the drive mechanism 450 causes the force element 400 to apply an occlusion force radially outward. The drive mechanism 450 may alternately be located on the outer perimeter of the peristaltic pump 100, such that the occlusion force is applied radially inward. The drive mechanism 450 preferably translates the force element 400 in an arcuate path of the substantially the same radius, more preferably a circular path. However, the drive mechanism 450 may translate the force element 400 in an eccentric path, a linear path, or any other suitable path. The drive mechanism 450 is preferably a rotor, driven by a motor, coupled to the force element(s) 400 by a linkage 460 system (e.g. a rigid, flexible or spring arm), as shown in FIG. 9B, but may alternately be bearing system or a planetary system (shown in FIG. 9A), wherein the rotor is analogous to the sun gear, the force elements 400 are analogous to the planetary gears braced against the rotor (planetary rotors), and the pressing surface 300 is analogous to the ring gear (ring surface). In the latter embodiment, the rotor is preferably actively driven, wherein the rotor rotates. However, the rotor may be a passive component, wherein the pressing surface 300 rotates and the angular position of the rotor stays substantially stationary. This may be accomplished in a vertically oriented peristaltic pump 100 by a mass eccentrically coupled to the rotor, wherein the central axis of the peristaltic pump 100 is perpendicular to the direction of gravity.

The restitution mechanism 700 of the peristaltic pump 100 functions to return the diaphragm 200 to its equilibrium, normal state. The restitution mechanism 700 preferably biases the unpressurized deformable volume 210 in an open configuration, reopening the deformable volume 210 after occlusion to enable the previously occluded section of the deformable volume 210 to fill with fluid and maintain flow. Reopening the deformable volume 210 preferably functions to assist in fluid intake, and may generate a suction force within the inlet 215 section of the deformable volume 210. The restitution mechanism 700 preferably utilizes the actuator 500, the diaphragm 200, a restitution element, or a combination of the above to achieve diaphragm restitution.

Figure 10A:
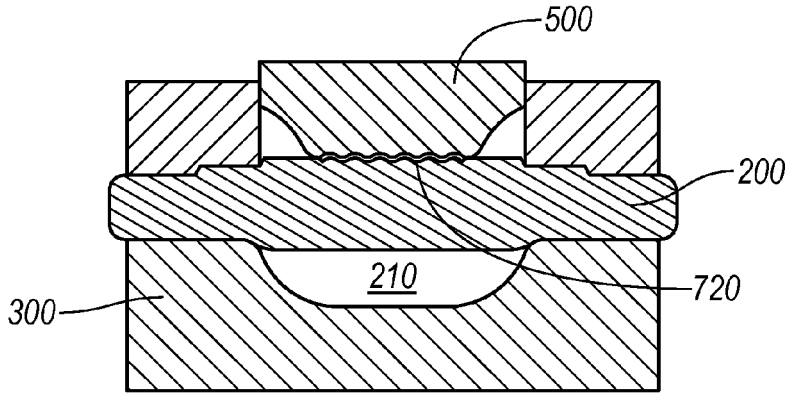
FIGS. 10A and 10B are a cross-sectional view of the first embodiment of the restitution mechanism, and an exploded view of a second embodiment of the restitution mechanism, respectively.

In a first variation, the restitution mechanism 700 utilizes the actuator 500, more preferably the geometry of the actuator 500, to achieve restitution, and preferably comprises coupling the diaphragm 200 to the actuator 500, such that the geometry of the actuator 500 pulls the diaphragm 200 back to the open configuration as the actuator 500 resumes an undeflected configuration. As shown in FIG. 10A, the actuator 500 is preferably coupled along its length 720 to the diaphragm 200 by an adhesive (e.g. rubber glue, tape, epoxy) or laminate, but may alternately be coupled by hooks, screws, bolts, clips, may be molded to the diaphragm 200, or may fasten using any other suitable coupling mechanism. Additionally, the actuator 500 is preferably held taut against the force element 400, such that the actuator 500 is biased toward the actuator restraint 620, pulling the diaphragm 200 toward the force element 400 and away from the pressing surface 300, effectively opening the deformable volume 210. In one preferred embodiment, the actuator 500 is a ring, dimensioned such that deflection by the force element 400 in one portion of the ring tensions/pulls the rest of the actuator 500 against the actuator restraint 620. However, the actuator 500 may facilitate restitution through the actuator spring force, wherein the actuator is substantially elastic (e.g. a reinforced elastic ring).

Figure 10B:
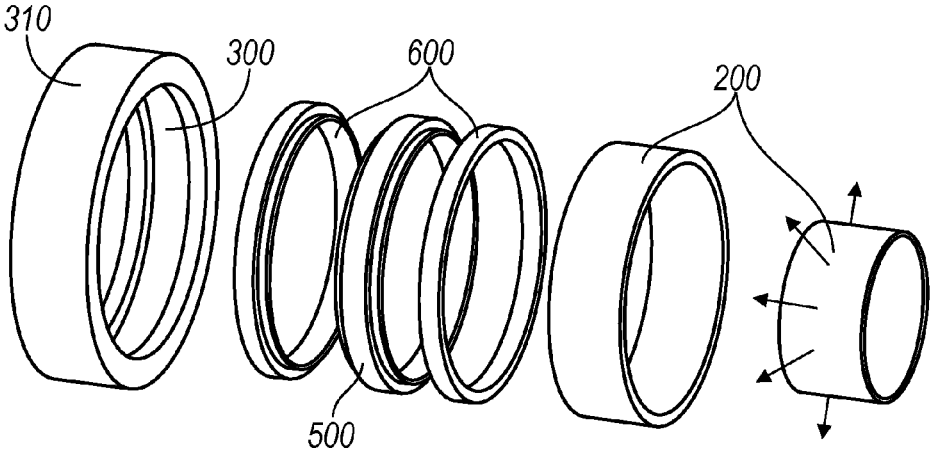

In a second variation, the restitution mechanism 700 utilizes the diaphragm 200, more preferably the spring force of the diaphragm 200, and preferably comprises pre-loading the diaphragm 200 in tension, such that the diaphragm 200 is biased in an open configuration. This is preferably applied to the sheet diaphragm 200 embodiment, but may alternately be applied to the tubular diaphragm 200 embodiment. The diaphragm 200 is preferably pre-loaded in the longitudinal axis (along the diaphragm 200 length), the lateral axis (along the diaphragm 200 width), along the radial axis (along the diaphragm 200 thickness), or a combination of the above. As shown in FIG. 10B, diaphragm 200 pre-loading is preferably accomplished by stretching the diaphragm 200 during assembly. For example, the longitudinal edges of the diaphragm 200 may be held in tension while the diaphragm restraint 640 is assembled against the diaphragm 200 and pressing structure to hold the diaphragm 200 in position, or the diaphragm 200 may be a ring, wherein the ring is stretched radially over the diaphragm restraint 640 to achieve tension. Alternately, the diaphragm 200 may be tensioned after assembly, wherein the diaphragm edges are pulled and fastened after the diaphragm restraints 640 are assembled. The diaphragm 200 may additionally/alternatively include restitutive elements formed therein. In one preferred embodiment, a thin restitution element is coupled or integrally formed into the longitudinal length of the diaphragm (e.g. by molding, gluing, forming during extrusion, etc.), wherein the restitution element has enough tensile strength to achieve diaphragm restitution. To accomplish this, the restitution element is preferably in radial tension such that the tension of the restitution element pulls on the diaphragm 200 to open the deformable volume 200. Similar to the actuator 500, the restitution element is preferably substantially stiff and strain-resistant, such that deflection of the restitution element/diaphragm 200 in one section pulls the undeflected portions of the restitution element/diaphragm 200 into an open configuration. Alternatively, the restitution element may be elastic (e.g. an elastic band) and be stretched over the support structure 600, wherein the spring force of the restitution element restitutes the diaphragm 500.

In a third variation, the restitution mechanism 700 may alternately and/or additionally utilize a restitution element that forces the diaphragm 200 into an open configuration. For example, a spring restitution element may be used, wherein the springs are located within the deformable volume 210 in an uncompressed state when the deformable volume 210 is in an open configuration. Alternately, the restitution element may be a set of spring elements, disposed along the longitudinal edges of the diaphragm 200 or the actuator 500, that are in an undeflected configuration when the deformable volume 210 is in an open configuration, and are in a deflected configuration when the deformable volume 210 is in an occluded configuration, such that the spring elements pull the diaphragm 200 or actuator 500 back into the rest position (open configuration position) when the diaphragm 200 or actuator 500 is deflected. However, the restitution mechanism 700 may utilize any suitable mechanism of facilitating restitution.

As shown in FIG. 1, the peristaltic pump 100 may additionally include a reservoir 800 (fluid receptacle) fluidly coupled to the outlet 217 of the deformable volume 210. The reservoir 800 functions to receive the pumped fluid, which is preferably pressurized. The reservoir 800 may additionally function to provide pressurized fluid to the application requiring the fluid (such as a tire). The reservoir 800 may also function to cool the pumped fluid. This cooling may be accomplished by three variations. In the first variation, the reservoir 800 is exposed to ambient air such that the fluid in the reservoir 800 is cooled to ambient temperature. In the second variation, the cooled, pressurized fluid from the reservoir 800 leaks into the fluid in the deformable volume 210 as one or more outlet(s) 217 are exposed, wherein fluid mixing cools the fluid in the deformable volume 210 as that fluid becomes pressurized to equilibrate with the fluid from the reservoir. In a third variation, the reservoir 800 is additionally fluidly coupled to a length of the deformable volume 210, preferably through small holes extending through the pressing surface 300 of the deformable volume 210, or alternatively through the diaphragm 200 of the deformable volume 210. The cooled, pressurized fluid leaks from the reservoir 800 into the deformable volume 210 as the holes are successively exposed to the low pressure side of the occlusion, and cools the contained fluid as it is pressurized due to equilibration with the fluid from the reservoir. The fluid contained in the reservoir 800 may additionally be used to purge the deformable volume 210 of unwanted liquids and gasses (e.g. oxygen, water).

Figure 11:
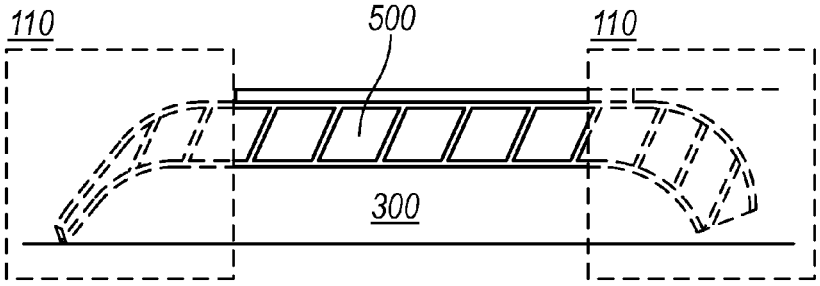
FIG. 11 is a view of an embodiment of the lead-in geometry.

As shown in FIG. 11, the peristaltic pump 100 may additionally include lead-in geometry 110, which functions to allow the smooth transition of the force element 400 onto the diaphragm 200 or actuator 500. The lead-in geometry 110 is preferably located near the ends of the deformable volume 210. The lead-in geometry 110 is preferably formed by the upper portion 320 of the support structure 600, wherein the upper portion 320 gradually tapers into the lower portion 340 of the support structure 600. However, the lead-in geometry 110 may alternatively be formed by the diaphragm 200, wherein the diaphragm 200 is formed to taper at the ends, preferably before the inlet 215 and after the outlet 217. The lead-in geometry 110 may also be formed by the actuator 500, wherein the height of the actuator 500 tapers at the ends. This geometry may also be formed by the interaction of the support structure 600 with the diaphragm 200 or the actuator 500, wherein the diaphragm 200 or actuator 500 have a continuous thickness or height, respectively, and the ends of the diaphragm 200 or actuator 500 are inserted into the lower portion 340 of the support structure 600. The lead-in geometry no may also include grooves 320 in the thickness of the upper portion 320 of the support structure 600, and guides extending from the centers of the force element 400 faces, wherein the guides fit into the grooves 320 and lift the force element 400 to the correct occluding height as the force element 400 rolls forward.

The peristaltic pump 100 may additionally include a housing, which functions to mechanically protect the components of the peristaltic pump 100. The housing may additionally function as a mounting point for the components, or be an integral piece with a component. For example, the rotor of the drive mechanism 450 may rotatably mount to the housing, or the pressing surface 300 may be an inner, arcuate surface of the housing. The housing is preferably a closed structure, such that it encapsulates the components of the peristaltic pump 100, but may alternately be an open structure. The housing is preferably a dry housing, but may be filled with lubricant to reduce friction on the components. The housing is preferably substantially rigid, and manufactured from materials compatible with the application. For example, the housing may be steel, aluminum, nylon, or any other suitable metal, polymer, or ceramic. The housing is preferably injection molded, but may alternately be stamped, extruded, sintered, or utilize any suitable method of manufacture.

As shown in FIG. 10B, a method of assembling a peristaltic pump includes the steps of coupling a support structure to an actuator strip, coupling the diaphragm to the support structure to form an occluding system, coupling the occluding system to the pressing surface, coupling a force element to the occluding system, and coupling a drive mechanism to the force element. In one embodiment of the method of assembling a peristaltic pump, the actuator includes a ring, the support structure includes two circular pieces that couple to the longitudinal edges of the actuator strip, the actuator strip includes a ring that is flexible in bending but stiff in tension (along the longitudinal axis), and the pressing surface is defined on the inner radial surface of a housing ring, wherein the pressing surface further includes a circumferential groove. The diaphragm is stretched over the support structure-actuator strip arrangement to form the occluding system. The occluding system is then coupled to the inner radial surface, or pressing surface, of a ring, wherein the support structure is pressed clipped, screwed, or otherwise mechanically coupled to the pressing surface. Because the diaphragm is disposed over the support structure, coupling the support structure to the pressing surface may also function to define the deformable volume. The force element is then coupled to a portion of the actuator strip, within the gap formed by the flanges of the support structure. The force element may be coupled to the drive mechanism prior to coupling to the actuator strip, but may alternately be coupled after coupling to the actuator strip, wherein the drive mechanism is coupled to the force element such that the force element disposes an occluding force against the actuator (and thus, diaphragm) that is sufficiently large to form an occlusion in the deformable volume. However, any suitable method of assembling the peristaltic pump in any other configuration may be used.

As a person skilled in the art will recognize from the previous detailed description and from the figures and claims, modifications and changes can be made to the preferred embodiments of the invention without departing from the scope of this invention defined in the following claims.

We claim:

1. A peristaltic pump system comprising:

a planetary rotor sub-system, including:

a rotor;

a ring defining a pressing surface along an inner bearing surface, the pressing surface defining a groove along a circumferential section, wherein the groove has a substantially well-shaped cross section; and a planetary roller element, driven by relative motion between the pressing surface and the rotor, wherein the roller element rolls along the pressing surface and applies an occluding force against the pressing surface;

an occlusion sub-system including:

a diaphragm that seals a groove opening, defining a deformable volume in conjunction with the groove, wherein the deformable volume is operable between:

an open configuration, wherein the deformable volume is unoccluded; and an occluded configuration, wherein the deformable volume is occluded;

an actuator strip, disposed between the roller element and the diaphragm, that biases the deformable volume to recover the open configuration, the actuator strip having a butte-shaped cross-sectional profile with a narrow occluding surface, a wide bearing surface, and radiused side walls, wherein the occluding surface is coupled to the diaphragm along the longitudinal centerline of the diaphragm, and the bearing surface couples to the roller element; and a support structure including:

a diaphragm restraint portion that clamps the diaphragm edges against the pressing surface of the ring; and an actuator restraint portion , disposed along the longitudinal edges of the actuator strip bearing surface, that limits the deflection of the actuator strip away from the pressing surface;

wherein the actuator strip is held in tension against the actuator restraint portion to bias the deformable volume in an open configuration;

wherein the occlusion system is operable in three modes:

a rest mode, wherein the deformable volume achieves the open configuration;

an occluded mode, wherein the roller element applies the occluding force to a localized section of the actuator strip bearing surface, deflecting the actuator strip such that the occluding surface deforms the diaphragm, occluding the corresponding section of the deformable volume; and a pressurized mode, wherein the pressure within the deformable volume is higher than ambient pressure, wherein the actuator restraint portion prevents actuator strip deflection, preventing diaphragm expansion, maintaining the volume of the deformable volume and maintaining the pressure within the deformable volume.

2. The system of claim 1, wherein the pressing surface rotates and the angular position of the rotor of the planetary rotor sub-system is held substantially static.

3. The system of claim 1, wherein the diaphragm is held in radial tension along the diaphragm thickness.

4. The system of claim 3, wherein the diaphragm sheet is a circular band, wherein the diaphragm is radially stretched over a circular support structure to achieve radial tension.

5. The system of claim 1, wherein the occlusion sub-system generates a suction force when shifting from occluded mode to rest mode.

6. A peristaltic pump system comprising:

an arcuate pressing surface;

a force element comprising a roller element that translates along the pressing surface and applies an occluding force towards the pressing surface;

a drive mechanism that facilitates force element translation, the drive mechanism comprising a planetary rotor system, wherein the roller element is a planetary roller and the pressing surface comprises a ring surface;

a diaphragm, disposed between the force element and the pressing surface, that defines a pump cavity, wherein the pump cavity is operable between an open configuration and an occluded configuration;

an actuator strip, disposed between the force element and the diaphragm, wherein the actuator strip is longitudinally aligned with the diaphragm, the actuator strip including:

an occluding surface that couples to the diaphragm and has a profile that minimizes diaphragm deformation stress; and a bearing surface that receives the occluding force from the force element and transmits the occluding force to the occluding surface;

wherein the force element deforms successive localized segments of the actuator strip, which deform successive sections of the diaphragm to occlude the corresponding segments of a deformable volume;

a support structure including:

a diaphragm restraint portion that couples the longitudinal edge of diaphragm against the pressing surface of the ring; and an actuator restraint portion, disposed along the longitudinal edges of the actuator strip bearing surface, that couples the actuator strip bearing surface to the pressing surface and limits the deflection of the actuator strip away from the pressing surface;

a restitution mechanism that recovers the open configuration of the pump cavity.

7. The system of claim 6, wherein the width of a gap formed along each longitudinal edge between the actuator strip and a support structure is controlled.

8. The system of claim 6, wherein rotation of the pressing surface drives roller element rotation.

9. The system of claim 6, wherein the pressing surface further includes a groove along the longitudinal centerline of the pressing surface.

10. The system of claim 9, wherein the pressing surface is concave.

11. The system of claim 9, wherein the groove has a substantially butte-shaped profile.

12. The system of claim 9, wherein the diaphragm substantially seals a groove opening to define the pump cavity.

13. The system of claim 12, wherein the diaphragm is a flexible sheet of substantially uniform thickness.

14. The system of clam 13 , wherein the diaphragm is raised along the longitudinal centerline, such that the diaphragm has a substantially bell-shaped cross section.

15. The system of claim 9, wherein the profile of the occluding surface compliments the body and edges of the groove.

16. The system of claim 6, wherein the restitution mechanism disposes the actuator strip in radial tension toward the actuator restraint portion.

17. The system of claim 16, wherein the actuator strip is stretched over the actuator restraint portion during assembly.

18. The system of claim 16, wherein the actuator strip is coupled to the diaphragm, such that the actuator strip tension recovers the open configuration of the pump cavity.

19. The system of claim 6, wherein the support structure clamps the diaphragm longitudinal edges to the pressing surface.

20. The system of claim 6, wherein the actuator restraint portion includes a pair of flanges, disposed along the longitudinal edges of the bearing surface, that prevent actuator deflection past a predetermined distance away from the pressing surface.

* * * * *